United States Patent [19]

Neelameggham et al.

[11] 4,401,465

[45] Aug. 30, 1983

[54] MAGNESIUM GRANULES COATED WITH FLUORIDE CONTAINING FLUX FOR DESULFURIZING STEEL

[75] Inventors: Ramaswami Neelameggham, Salt Lake City, Utah; John C. Priscu, Las Vegas, Nev.

[73] Assignee: AMAX Inc., Greenwich, Conn.

[21] Appl. No.: 421,888

[22] Filed: Sep. 23, 1982

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,957,502 | 5/1976 | Cull | 75/58 |
| 4,076,522 | 2/1978 | Yoshida | 75/58 |
| 4,331,711 | 5/1982 | Skach | 75/58 |

*Primary Examiner*—P. D. Rosenberg

*Attorney, Agent, or Firm*—Michael A. Ciomek; Eugene J. Kalil

[57] ABSTRACT

A desulfurizing agent is provided comprising magnesium granules having a surface consisting essentially of a fluoride-containing salt.

7 Claims, No Drawings

MAGNESIUM GRANULES COATED WITH FLUORIDE CONTAINING FLUX FOR DESULFURIZING STEEL

This invention relates to substantially non-hygroscopic flux coated magnesium granules and, in particular, to flux-coated granules having reduced pyrophoricity at elevated temperatures when employed as a desulfurizing agent for steel.

STATE OF THE ART

Magnesium is employed as an external addition to molten iron or steel to reduce sulfur and oxygen, thus improving the physical and chemical properties of the final product.

For example, in the casting of ferrous metals it is the usual procedure to add a deoxidizing agent such as Mg, Al, etc., before casting in order to deoxidize the molten ferrous metal of absorbed oxygen which can adversely affect the physical properties of the finished product.

In addition to deoxidation, some metal products require a reduction of sulfur content which also has an adverse effect on the physical properties of finished product.

Magnesium, a strong desulfurizing agent, has been found very useful for that purpose since it is a very reactive element at elevated temperatures. When introduced under the surface of molten iron or steel at temperatures of about 2300° F. to 2700° F., the magnesium which has a boiling point of 2024.8° F., vaporizes and reacts violently with the oxygen and sulfur in the steel. The gas bubbles quickly rise to the surface along with bubbles of expanded inert carrier gases. This action is hazardous and causes molten metal to splash with the consequent loss of metal and reagent. Another problem is the tendency for superheated magnesium to react with air which results in a voluminous dense cloud of magnesium oxide dust.

It has been found convenient to add the magnesium in the form of granules coated with fused salt mixtures containing NaCl, KCl, $CaCl_2$, $MgCl_2$, and the like. These mixtures may also contain oxides of these elements. The coated granules are injected well below the molten iron or steel surface through a lance using a stream of suitable carrier gas at a rate to control the reaction violence to assure a beneficial stirring action, while minimizing loss of magnesium vapor to the atmosphere.

The salt coating is claimed to avoid plugging of the lance, to slow the rate of reaction and to better control the addition rate of the granules. Another advantage of the chloride coating is to reduce the pyrophoricity of the magnesium granules, and to protect the granules from corrosion in air in the shipping container. However, a disadvantage of these salt mixtures is that they are somewhat hygroscopic, and have a tendency to absorb moisture on exposure to air which causes "caking" of the granules. Also on long time exposure, the magnesium granule will corrode and form hydrous oxides or hydroxy chlorides.

It is known to coat magnesium granules with clay slips, bentonite, and the like, which coating tends to cause caking of the granules.

It would be desirable to provide flux-coated magnesium granules which are substantially non-hygroscopic and can be easily handled when being added to a molten metal bath, such as steel. The flux should also aid in reducing pyrophoricity at elevated temperatures.

OBJECT OF THE INVENTION

It is thus an object of the invention to provide substantially non-hygroscopic flux-coated magnesium granules in combination with reduced pyrophoricity.

Other objects will clearly appear when taken in conjunction with the following disclosure and the appended claims.

STATEMENT OF THE INVENTION

The desulfurizing agent provided by the invention comprises magnesium granules having a surface coating consisting essentially of a fluoride-containing salt.

Examples of such salts are alkali and alkaline earth metal fluorides and fluoborates. The term "fluoride-containing salts" as employed hereinabove includes fluoborates. Examples of such salts are NaF, KF, $NaBF_4$, $KBF_4$, $CaF_2$, $CaBF_6$, and the like.

The mineral fluorospar ($CaF_2$) is well known as a flux in steel making and is particularly useful as a flux coating for magnesium.

DETAILS OF THE INVENTION

As the main purpose for the flux coating is to reduce pyrophoricity, a simple test may be employed in which a small pile of granules, coated and uncoated, is subjected to the direct flame of a Bunsen burner or a propane torch. A typical pile for testing is one weighing about 100 grams.

The pile is supported on a high temperature resistant insulating board and exposed to the flame. The granules prior to coating has a size of −10 mesh (U.S. Standard), the average size ranging from about 50 mesh to 10 mesh. The granules tested includes the following: (1) no coating, (2) chloride salts, (3) fluorspar-fluoborate mix, (4) iron-coated granules with precipitated fluoride on the surface, (5) dry coating of $KBF_4$ with $Al_2O_3$, and (6) dry coating of $KBF_4$ alone.

The results are determined in terms of burning time following application of the flame as follows:

| Type of Coating | Burning Time, Secs. | Comments |
|---|---|---|
| (1) None | 7–10 | Ignition spreads rapidly from one granule to another. |
| (2) Chloride Salts | 180–200 | Initially, the melting of the chloride salts provides a flux cover and then oxidizes enough to cause the granules to burn. |
| (3) Fluorspar-Fluoborate Mix | 150–200 | The flux coating gets red hot without the magnesium burning until later, similarly to the chloride coating. |
| (4) Iron-Coated Mg with Precipitated Fluoride on Surface | 200–270 | Similar to test 3. |
| (5) Dry Coatings of $KBF_4$ with $Al_2O_3$ | 300 plus | This flux when melted protects the granules for a longer period than test 2. |
| (6) Dry Coating of $KBF_4$ | 300 plus | This flux when melted protects the granules for a longer period |

-continued

| Type of Coating | Burning Time, Secs. | Comments |
|---|---|---|
| | | than test 2. |

As stated earlier, an advantage of the fluoride-containing flux is that it is substantially non-hygroscopic and also is at least as good as, if not better, as a flux coating for magnesium granules than the chloride flux.

The flux-coated magnesium granules of the invention is particularly useful for the desulfurization of steel. The procedure of steel-making is well known and need not be repeated here.

The steel bath is established using well-known techniques and the bath subsequently desulfurized by adding to it a measured amount of the fluoride-coated granules. As the flux coating melts, it protects the magnesium against pyrophoricity as it melts and is being absorbed by the steel bath. The magnesium reacts with the contained sulfur to form magnesium sulfide which is taken up by flux or slag on the surface of the molten steel bath. Steel ingots are then cast in the well-known manner.

In producing the flux coating, the following methods may be employed:

EXAMPLE 1

A fluorospar-fluoborate mix is produced by forming a molten slurry of 5% by weight of fluorospar in a 500-gram bath of potassium fluoborate (or sodium fluoborate) at a temperature of about 550° C. which is lower than the melting point of magnesium (652° C.). About 100 grams of magnesium granules are mixed with the bath and following solidification the solidified mix is broken into −10 mesh particles with the magnesium substantially distributed through the flux matrix. Fines are removed by screening, leaving coated magnesium granules. The coating on the granules may range up to about 15% by weight of the coated granules.

EXAMPLE 2

A dry coating of $KBF_4$ with $Al_2O_3$ is produced as follows:

About 100 grams of magnesium granules (ranging from 100 mesh to 10 mesh) are mixed with 30 grams of flux mixture comprising a mixture of 20%–600 mesh $Al_2O_3$ and 80% $KBF_4$.

Following mixing in a blender, the granules are coated with the flux composition to provide a coating containing $KBF_4$–$Al_2O_3$.

The fines are then screened out to provide a coated magnesium granules comprising a 95% magnesium metal.

EXAMPLE 3

Magnesium granules are provided with a coating of iron by using one of three solutions as follows:

(1) A ferrous ammonium sulfate with a citrate buffer and neutralized with $NH_4OH$. The solution prepared contains 50 grams/liter of $Fe^{++}$, 2 grams/liter (gpl) of sodium citrate and enough $NH_4OH$ to provide a pH of 6.

The granules are added to the solution and iron deposited chemically on the surface thereof. The granules are thereafter washed preparatory to forming a flux coating thereon.

(2) A ferrous ion solution is prepared by dissolving 50 gpl of ferrous chloride and 50 gpl of calcium chloride in water. The solution is neutralized with $Ca(OH)_2$ to pH 6. Granules are added to the solution and an iron chemically deposited on the surface thereof. The iron-coated magnesium granules are water washed as stated above.

(3) ferrous fluoborate is dissolved in water to provide a solution containing 100 gpl of the salt. Thereafter, iron is chemically deposited upon the magnesium granules and the iron-coated granules thereafter washed.

Following production of the magnesium granules with a layer of metallic iron, the granules are treated with a 1% solution of sodium fluoride or hydrogen fluoride to provide a fluoride outer coating by reaction. The coating on the magnesium granules may range from about ½ to 5% by weight of the coated granules.

EXAMPLE 4

The magnesium granules may be provided with a fluorospar-$KBF_4$ coating by forming a dry mixture of magnesium granules of 100 to 10 mesh size with a total of about 5% by weight of a 50/50 mixture of fluorospar-$KBF_4$ of −100 mesh and gently tumbling the mixture in a ball mill to effect coating of the granules. The coating has a melting point less than magnesium.

The fluoride-containing coating can also be used on magnesium granules containing a layer of chloride salt. The chloride-coated granules may be coated with a fluorospar-fluoborate mix using the dry coating technique of Example 4.

The fluoride-containing coating comprises an effective amount ranging up to about 15% by weight of the coated granules (e.g., about ½ to 15%), for example about ½ to 8%, a preferred range being about ½ to 5%. Prior to coating, the magnesium granules have an average size ranging from about 100 to 10 mesh (U.S. standard).

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A desulfurizing agent comprising magnesium granules having a surface coating consisting essentially of a fluoride-containing salt in an amount ranging from about ½ to 15% by weight of the coated granules.

2. The desulfurizing agent of claim 1, wherein said surface coating is selected from the group consisting of at least one alkali and alkaline earth metal fluoride and fluoborate.

3. The desulfurizing agent of claim 1, wherein said granules have a layer of a hygroscopic chloride salt and an outer surface coating of said fluoride-containing salt.

4. The desulfurizing agent of claim 3, wherein said outer surface coating consists essentially of a fluorspar-fluoborate mix.

5. The desulfurizing agent of claim 1, wherein the magnesium granules without the surface coating have an average size falling in the range of about 100 to 10 mesh.

6. The desulfurizing agent of claim 1, wherein the surface coating is selected from the group consisting of at least one alkali and alkaline metal fluoride and fluoborate mixed with a fine dispersion of $Al_2O_3$.

7. The desulfurizing agent of claim 1, wherein the surface coating is an amount ranging from about ½ to 8% by weight of the coated granules.

* * * * *